United States Patent [19]

Ott

[11] 4,335,969

[45] Jun. 22, 1982

[54] PRINT HEAD

[75] Inventor: Hubert Ott, Ravensburg, Fed. Rep. of Germany

[73] Assignee: Mannesmann Aktiengesellschaft, Dusseldorf, Fed. Rep. of Germany

[21] Appl. No.: 165,798

[22] Filed: Jul. 3, 1980

[30] Foreign Application Priority Data

Jul. 4, 1979 [DE] Fed. Rep. of Germany ..... 2927385

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 3,929,214 12/1975 Hebert ..... 400/124
4,165,940 8/1979 Cacciola ..... 400/124
4,208,138 6/1980 Volke ..... 400/124
4,240,756 12/1980 Ku et al. ..... 400/124
4,244,658 1/1981 Mori ..... 400/124

*Primary Examiner*—Paul T. Sewell
*Attorney, Agent, or Firm*—Ralf H. Siegemund

[57] ABSTRACT

A guide member for print needles and a base plate with guide apertures traversed by the rear end of the needles are bolted to a magnetic core element, having annularly arranged poles; a cover is also bolted thereto, sandwiching a case in between. The cover centers an annular element having radial spring arms which hold one end each of a plurality of armatures respectively against the annularly arranged poles. The spring arm ends and the armature ends have interlinked, raised edges for obtaining a hinged link. The other ends of the armatures engage the rear ends of the needles. The annular element carries the respective electromagnetic coils and cores.

9 Claims, 10 Drawing Figures

PRINT HEAD

BACKGROUND OF THE INVENTION

The present invention relates to a print head of the type in which individual print needles or styli are propelled forward, individually and in accordance with a program, to be retracted after they have impacted upon a printing surface. The forward or advance motion is usually caused by an electromagnet, the retraction results from spring bias. There are as many electromagnets as there are needles.

U.S. Pat. No. 3,929,214 is representative of this state of the art. The electromagnets are arranged in a circle, and each one operates an armature. The armatures are positioned by means of a star-shaped connecting element having radial outward extending holding arms for engaging the armatures. The particular device disclosed in this patent requires a certain degree of lateral play between armature and spring arm to assure that the armature is freely pivotable. This play, however, can translate into a fairly large, lateral pivot motion because the armature is much longer than it is wide. This lateral pivot motion must be impeded and requires, therefor, certain guidance. It must be observed, however, that particularly in rapid action devices guide elements and structure experience more or less rapid wear.

DESCRIPTION OF THE INVENTION

It is an object of the present invention to improve print heads having multiple electromagnets with individual armatures, in which lateral pivot motion of such an armature (as distinguished from the regular armature pivot motion) is prevented without particular guide elements.

It is another object of the present invention to improve the structural stability of the electromagnet-armature-needle assembly and the accuracy of their mutual positioning.

The invention, therefore, presents an improvement of print heads having plural print needles mounted for guidance of longitudinal, forward and reverse stroke motion. The rear ends of these needles are arranged in a circle, each engaging an armature of an electromagnet, there being as many armatures and electromagnets as there are needles accordingly.

In accordance with the preferred embodiment of the present invention, it is suggested to position the armatures as follows. Each electromagnet has a particular pole piece having a particular end surface against one end of which the respective armature abuts. The armature is held against that surface by means of a spring having radial spring arms known generally per se, but the ends of these arms are specifically configured. The arms have downwardly raised edges, configured as U-shaped lugs, in which are inserted respectively upwardly raised edges at an end portion of the respective armature. The spring element is centered and its arms hold the armature against any radial displacement. The interengaging lugs define the hinge axis for the respective armature in a manner which does not require any space for lateral play. Thus, any means for laterally restraining the armature at points close to their needle-engaging tips do not have to be provided for.

In furtherance of the invention, it is suggested to use a common annular core element for all electromagnets with axially extending pole arms and to use this element as a central mounting and reference element. The needle and stylus guide head portion and a base plate for a jacket portion are bolted to the core element from one side, while a cover is bolted also to the core element on the other side and spaced apart therefrom, the case or jacket being located in between. The cover, in particular, centers the multiarm spring to which the armatures are hingedly linked.

The preferred embodiment of the invention, the objects and features of the invention, and further objects, features and advantages thereof, will be better understood from the following description taken in connection with the accompanying drawings.

Figure 1:
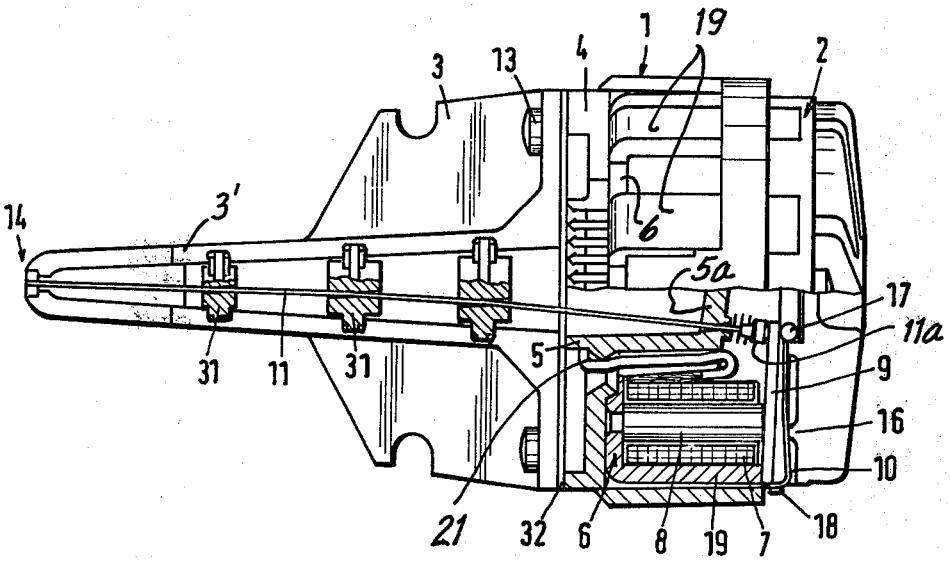
FIG. 1 illustrates a print head with pivotal armatures, partially as a top elevation, partially as a cut-open and cross sectional view, and constructed in accordance with the preferred embodiment of the present invention for practicing the best mode thereof.

Proceeding now to the detailed description of the drawings, the print head and its parts, as depicted in the various figures, include a case 1 or jacket having an overall cylindrical configuration, but being to some extent of an open construction. The case 1 includes a base plate 4 assembled with guide and support member 3 for print needles or styli 11. The case part 1 is provided on its other (axial) side with a cover 2. Elements 1, 2, and 3 together establish a housing for the print head in which plate 4 can be deemed a partition.

The guide and support element 3 includes an extension 3' having a mouth portion 14 which, in turn, includes a plurality of apertures. Element 3 is provided for supporting particular mounting guide pieces and elements 31. These guide elements hold, support, and guide the plurality of print needles or styli 11, whose front ends and respective tips are disposed in mouth piece 14. These needles are advanced and retracted through that mouth piece to impinge upon a piece of paper, or the like, to leave an imprint thereon, there being an ink ribbon interposed between the pin tips and the paper. Paper, a platen for supporting the paper, and ink ribbon are not shown; they are conventional. Spacer disks 32 are disposed between case or jacket 1 and the guide and support 3. The base 4 is provided with a pot-shaped core or center piece 5, which projects into the interior of case or jacket 1. The bottom **5*a* of center piece 5 is provided with apertures 5*b*, which receive the rear end portions of the print needles or styli 11**.

Figure 3:
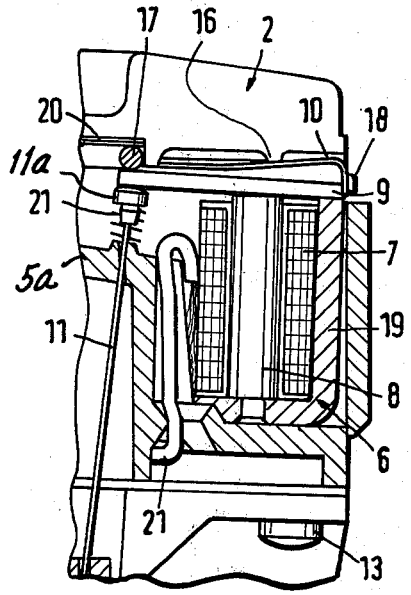
FIG. 3 shows a detail of FIG. 1 on an enlarged scale.

The particular one needle of the plurality of needles, as depicted in FIGS. 1 and 3, is representative of that plurality of nine stili. The number NINE is customary, though simpler heads use only seven; but the invention is not limited to any particular number of styli. This needle or stylus, as well as all the others, has a rear end head 11*a* bearing against the free end of a hinged and pivoted swivel-armature 9. A spring 21 is interposed between support bottom 5*a* and print head 11*a* to urge the print head against the armature. The spring tends to expand, which means it tends to retract the needle 11, so that its tip is completely retracted into mouthpiece 14.

Each of the armatures 9 is operated by, respectively, an electromagnet which is comprised of a coil 7 on a core element 8 and a yoke arm member 19. Coil 7 actually sits on a bobbin or coil carrier, having a central opening which is traversed by the core 8. Reference numeral 41 refers to conductors and leads for feeding electric current to the coils 7, on an individual basis. Cutouts 5*c* in center portion 5 are provided to accommodate these leads.

Concerning the coil carrier 6, it may be constructed as shown in my copending patent application Ser. No. 128,484, filed on Mar. 10, 1980. Broadly speaking, the coil carrier 6 is of annular construction and has pole or yoke arms 19 which extend axially. These arms run parallel to the respective cores 8 and, respectively, in radial alignment therewith. Cores 8 are inserted in the flat annular part of carrier 6. As will be described below, carrier 6 serves actually as the central mounting element "around" which all housing parts are assembled and to which they are secured.

Each armature has one end positioned to bear against the free end of the respective yoke and pole arm 19. The retaining force is provided by a radially extending arm of a spring element 10, shown in greater detail in FIGS. 4 and 5. The element has spring arms 22 and inner periphery 10*a*. Spring element 10 is centered in cover 2. Recesses 33 of arcuate contour are provided between the spring arms 22. Centering elements 30, extending from cover 2, have a matching contour to, thereby, positively center the spring 10 as a whole and azimuthally with respect to each spring arm. Element 10 bears against inside support extension 16 of that cover for the purpose of multipoint support. Additionally, a stop ring 17 is held in cover 2 and positioned by means of spacing disks 20. The disks are provided in number and thickness to establish one end or terminal position of the free, radially inwardly extending ends of all armatures. The free ends of armatures 9 are urged against that ring 17 by the print heads 11*a* of the styli; the springs 21, of course, hold these print heads and abutting armature ends in this terminal position.

Figure 2:
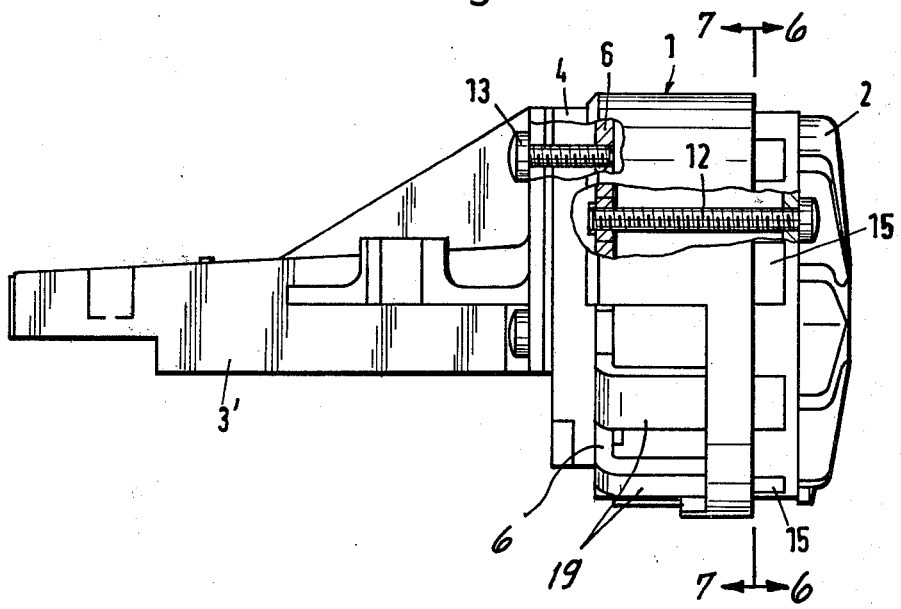
FIG. 2 is a side view of the head shown in FIG. 1, under emphasis of particular features.
Figure 7:
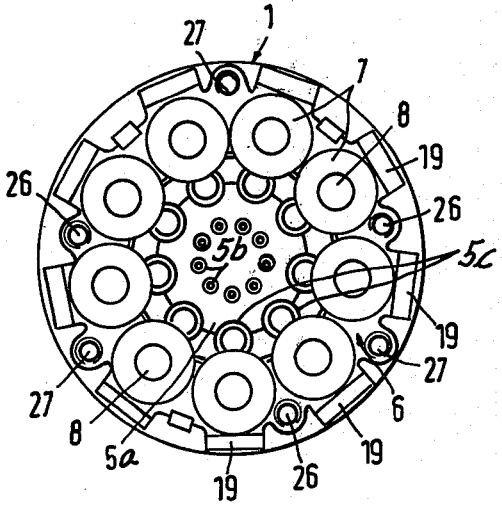
FIG. 7 is a front view into the interior of the print head; the figure can be understood as a view in a direction opposite the direction of view of FIG. 6.

Bolts, such as bolt 12, secure the cover 2 to the coil carrier 6, so that the cover 2 bears on that end of case 1. Carrier 6 is, therefore, provided with bores 27 to receive these bolts (see FIG. 7). On the other hand, base 4 of case 1 and the spacer disks 32 are clamped between coil carrier 6 and support member 3. Bolts 13 are provided for that purpose (FIGS. 2 and 3) and carrier 6 has threaded bores 26 to receive these bolts 13 (FIG. 7). It can, thus, be seen that the coil carrier 6 is, indeed, the basic element to which the housing elements 1, 2, and 3 are mounted. The primary aspect of this feature is that the carrier 6 serves as a reference element for positioning other parts, case, cover and guide members as well as the electromagnetically actuated parts which are, thereby, positioned in relation to the styli as held in member 3.

Figure 4:
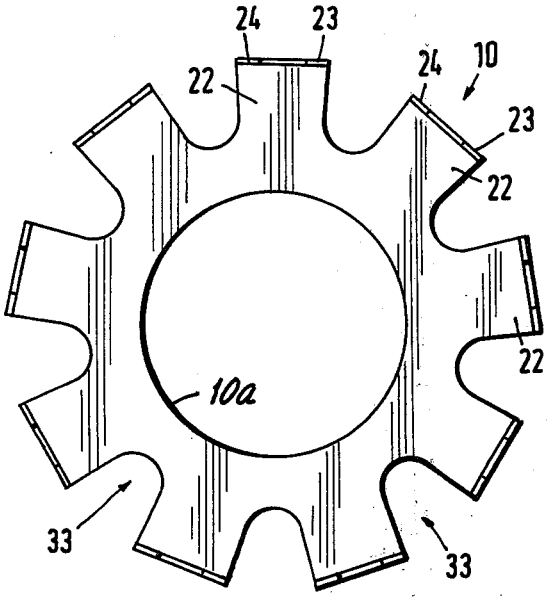
FIG. 4 is a top elevation of a spring element used in the print head shown in FIGS. 1, 2, and 3.
Figure 5:
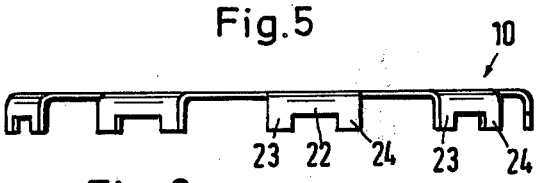
FIG. 5 is a side view of the element shown in FIG. 4.

FIGS. 4 and 5 show the spring element 10 in greater detail. The element is designed for cooperation with nine styli or print needles; a different number can readily be accommodated by a spring element with a different number of arms. The arms 22 have downwardly raised edges, each being configured, in elevation, to resemble a U. Such a U has two legs, 23 and 24, between which is received the raised or bent up rear edge portion of the respective armature, this edge being an upwardly extending lug 18 of armature 9.

For ease of mounting, raised edge 18 of each armature has a height that is smaller than the thickness of the armature. This feature permits accurate positioning of each armature inside the print head housing under avoidance of detrimental feedback effects of the mounting. The raised edge, flange, or lug 18 has to be sufficiently high, however, in order to firmly abut against the yoke part of the U between legs 23 and 24 of the respective spring arm.

Figure 6:
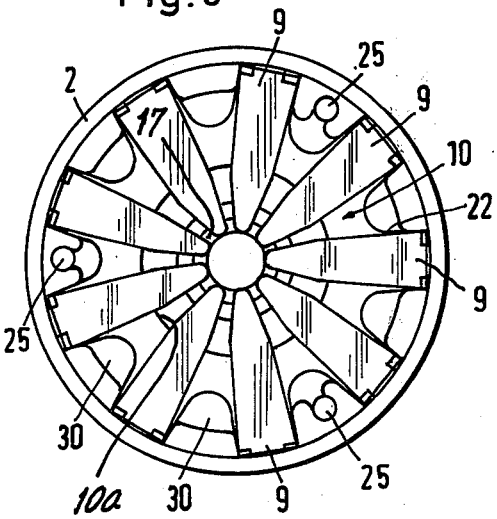
FIG. 6 is a front view into the interior of a print head cover shown in FIG. 1, et seq.
Figure 8:
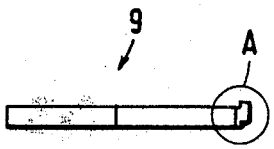
FIG. 8 is a side view of one of the pivot armatures used in the print head shown in the various figures.
Figure 10:
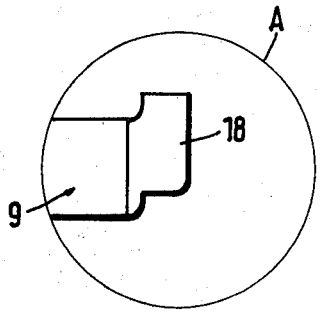
FIG. 10 is an enlarged view of a detail identified by character A in FIG. 8.
Figure 9:
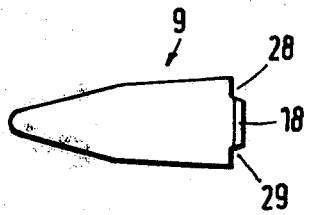
FIG. 9 is a top elevation of the armature shown in FIG. 8.

FIGS. 8, 9, and 10 show the armature in greater detail, depicting in particular the upwardly extending or bent up lug 18. The lug is narrower than the adjacent portion of the armature, defining recesses 28 and 29. These recesses receive U-legs 23 and 24 of, respectively, the end portion of a spring arm 22 of element 10. The arm, it will be recalled, forces that end portion of the particular armature 9 against a yoke and pole arm 19. This arrangement defines, in fact, the hinge axis for the armature. The legs 23 and 24 prevent additionally a radial outward displacement of the armature. The upwardly turned lug 18 bears against the crossbar portion of the U at the spring arm's end to, thereby, prevent radial inward displacement of the armature. Thus, the hinge axis of the armature is well defined and will not be displaced. Moreover, no play is needed as between legs 23 and 24 and the portion of the armature from which flange or edge 18 extends. Thus, any lateral displacement of the armature, as it is held, is not permitted. It is for this reason that the armatures do not need any further restraint from pivoting, e.g., in the plane of the drawing of FIG. 6.

Cover 2 is provided with windows 15 which are aligned with the armature ends and the yokes 19. These windows receive the armature lugs 18 and U-legs 23 and 24, permitting them to move freely for positioning so that their respective positions will be determined only by the arms 22 of the centered spring element 10.

The invention is not limited to the embodiments described above; but all changes and modifications thereof, not constituting departures from the spirit and scope of the invention, are intended to be included.

I claim:

1. A print head, comprising:

first means including a plurality of apertures for mounting a print needle of a plurality of such needles for longitudinal displacement so that the respective tips of the needles can be advanced for printing, respective other ends of the needles extending rearwardly from the first means;

a plurality of electromagnets, each including a coil and pole-defining means, the pole-defining means including for each magnet a particular pole having an end surface, the end surface of the pole-defining means of the plurality of electromagnets being annularly arranged;

a spring element having a plurality of radially outwardly extending spring arms, each spring arm having a bent-up edge of U-shaped elevation, the U having two legs and a cross-portion, the legs having their ends located above said particular, annularly arranged poles;

second means connected to the first means for centering the spring element; and a plurality of generally flat, radially arranged armatures, each having a first, radially inner end engaging the other end of one of said needles, each armature having a second, radially outer end with a bent-up lug that fits between the legs of the respective spring arm, the bent-up edge of the respective armature engaging the cross-portion of the U having the latter legs.

2. In a print head as in claim 1, the armature having a particular thickness, the bent-up leg of the armature having a height lower than the thickness of the armature.

3. A print head as in claim 1, the first means including a base having a center portion being provided with an annular arrangement of apertures, for guiding rear-end-near-portions of the needles.

4. A print head as in claim 1, said second means including a head cover, the cover being provided with particular elements being received in between the arms.

5. A print head as in claim 1, the pole defining means including a plate from which extend axially said particular poles.

6. A print head as in claim 1, said first means including a guide element having a mouth piece for receiving the tips of the needles, said pole-defining means including a plate from which extend said particular poles, the guide element being bolted to said plate.

7. A print head as in claim 6, said second means including a head cover, bolted to said plate and including contoured extensions lodged between said spring arms for centering the spring element, there being a jacket element interposed between the plate and the cover.

8. A print head, comprising:

a base member having a center piece which includes a plurality of annularly arranged apertures;

a needle guide member having needle guide means and a mouthpiece;

a plurality of print needles disposed in the needle guide means so that respective tips of the needle are located in and project from the mouthpiece, the rear end of the needles projecting through and from said apertures;

an annular core element having a plurality of pole arms extending axially, said guide member being bolted to the core element, thereby holding the base element;

a case on the base member;

a cover bolted to the core element, thereby urging the case against the core element;

a spring member having plural spring arms, and being centered in the cover;

a plurality of armatures, each having one end hingedly engaging one of the spring arms, one spring arm per armature, to, thereby, hold the armature ends against the pole arms, respectively;

spring means for holding the rear end of the needles against respective other ends of the armature.

9. A print head as in claim 8, the rear ends of the armatures having each a bent-up lug, the spring arms' front each having a bent-up edge of U-shaped profile behind which is lodged the respective bent-up lug of the respective armature to, thereby, establish a respective hinge axis.

* * * * *